United States Patent [19]

Crumby

[11] Patent Number: 4,709,526

[45] Date of Patent: Dec. 1, 1987

[54] MORTAR APPLICATION TEMPLATE

[75] Inventor: John T. Crumby, P.O. Box 23304, Knoxville, Tenn. 37923

[73] Assignee: John T. Crumby

[21] Appl. No.: 853,852

[22] Filed: Apr. 21, 1986

[51] Int. Cl.[4] ..... E04D 15/00

[52] U.S. Cl. ..... 52/749; 52/DIG. 1

[58] Field of Search ..... 52/749, DIG. 1; 222/611; 249/83, 90

[56] References Cited

U.S. PATENT DOCUMENTS

| | | | |
|---|---|---|---|
| 2,652,714 | 9/1953 | Sommers | 52/749 |
| 3,148,432 | 9/1964 | Garrett, Jr. | 222/611 X |
| 3,203,070 | 8/1965 | Kolakowski et al. | 249/90 X |
| 4,074,503 | 2/1978 | Watt et al. | 52/749 |
| 4,352,445 | 10/1982 | Cusumano et al. | 52/749 X |

FOREIGN PATENT DOCUMENTS

| | | | |
|---|---|---|---|
| 1096113 | 6/1955 | France | 222/611 |
| 314493 | 9/1969 | Sweden | 52/DIG. 1 |

*Primary Examiner*—Carl D. Friedman

*Attorney, Agent, or Firm*—Pitts and Brittian

[57] ABSTRACT

A template device (12) for applying mortar to a surface of precast concrete block (10) of the like. The device includes a frame (28) which has an outline similar to the outline of the surface of a standard precast concrete block (10) upon which similar blocks are stacked during building operations. Walls (30) served to define openings in the template device which are substantially coextensive with the sections of the surface of the block upon proper placement of the device thereon. Cover members (36) of the frame are substantially coextensive with openings in the block to prevent waste of mortar into those openings. A guide (40) is provided to facilitate proper positioning of the device squarely on the a block (10) prior to the application of mortar thereto. The device (12) assists those skilled and unskilled in precisely controlling the thickness and placement of mortar on precast concrete blocks of standard sizes during building operations.

7 Claims, 2 Drawing Figures

MORTAR APPLICATION TEMPLATE

TECHNICAL FIELD

This invention relates generally to apparatus for assisting in the application of mortar to precast concrete building blocks, and more particularly concerns a template device which assists in controlling the proper placement and depth of the mortar applied to surfaces of such building blocks upon which additional blocks are stacked during building operations.

BACKGROUND ART

Heretofore, various devices have been known for assisting the application of mortar or other suitable building material to the surface of a concrete block or the like. Such devices are generally designed to assist the user in applying proper amounts of mortar at proper locations on the surface of such building blocks, in particular precast concrete blocks. Known prior devices are disclosed in the following U.S. Pat. Nos.: 2,940,298; 3,545,159; 3,696,576; 3,937,511; 4,091,587; and 4,352,445.

It will be noted upon reviewing these known patents, certain of the devices which assist in the application of mortar to concrete blocks are expensive to manufacture and require substantial labor and skill to operation. The device of the present invention is designed such that an unskilled laborer can readily apply correct thicknesses of mortar at proper locations on the surface of standard precast building blocks such as blocks having one or more openings therein. Accordingly, it is an object of the present invention to provide a template device for applying mortar to a building surface of a precast concrete block or the like which can be used by a skilled or unskilled laborer for the proper placement of mortar on such blocks in desired thicknesses. As used herein the term "building surface" is meant the exposed top surface of a block that has already been set in place. At times it is referred to as "block surface+ or "top surface." This template device can be used by a novice with consistent results. It is substantially inexpensive to manufacture, durable and when properly used, will provide savings in both time and materials since the placement of the mortar is precisely controlled.

DISCLOSURE OF THE INVENTION

Other objects and advantages of the present invention will be obvious, and will in part appear hereinafter, and will be accomplished by the present invention which provides a template device for applying mortar to standard precast concrete blocks or the like. These blocks normally define building surfaces having substantially rectangular perimeters with parallel longitudinal sections joined at their ends by parallel lateral sections of lesser lengths. At least one further parallel lateral section interconnects the longitudinal sections at spaced locations from the end portions thereof to define two or more openings in such blocks. A frame is provided which includes walls that define openings which are substantially coextensive with the longitudinal and lateral sections of the blocks upon proper placement of the frame on the building surface. A guide assists in proper placement of the frame on the building surface of the block such that the openings are aligned with the longitudinal and lateral sections of the blocks surface. A handle serves to assist in gripping the device to move it to another block in the wall course.

BRIEF DESCRIPTION OF THE DRAWINGS

The above mentioned features of the present invention will be more clearly understood from consideration of the following description in connection with the accompanying drawings in which.

BEST MODE FOR CARRYING OUT THE INVENTION

Figure 1:
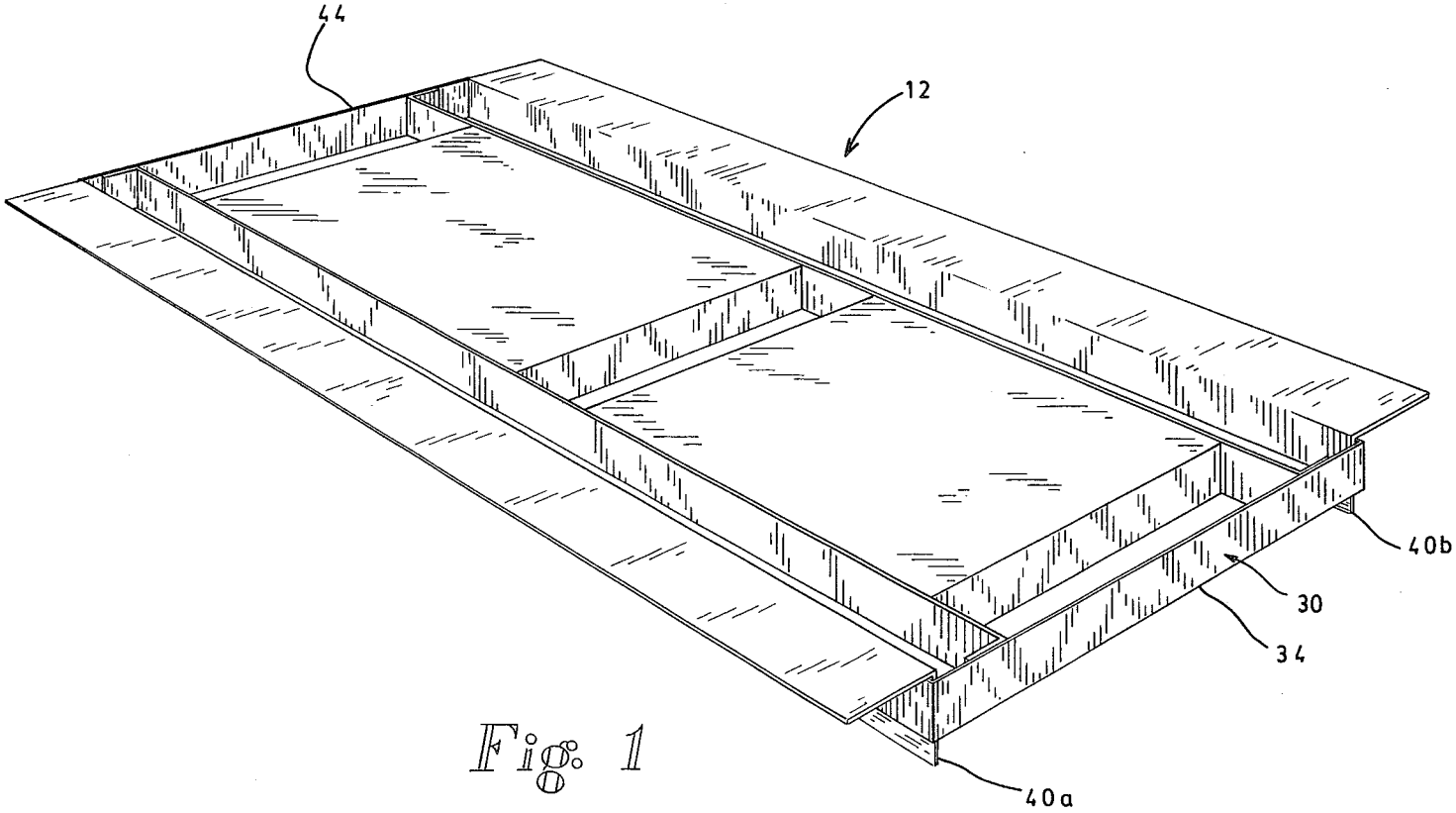
FIG. 1 a perspective view showing a template device for applying mortar to a surface of a precast block or the like constructed in accordance with various features of the present invention.
Figure 2:
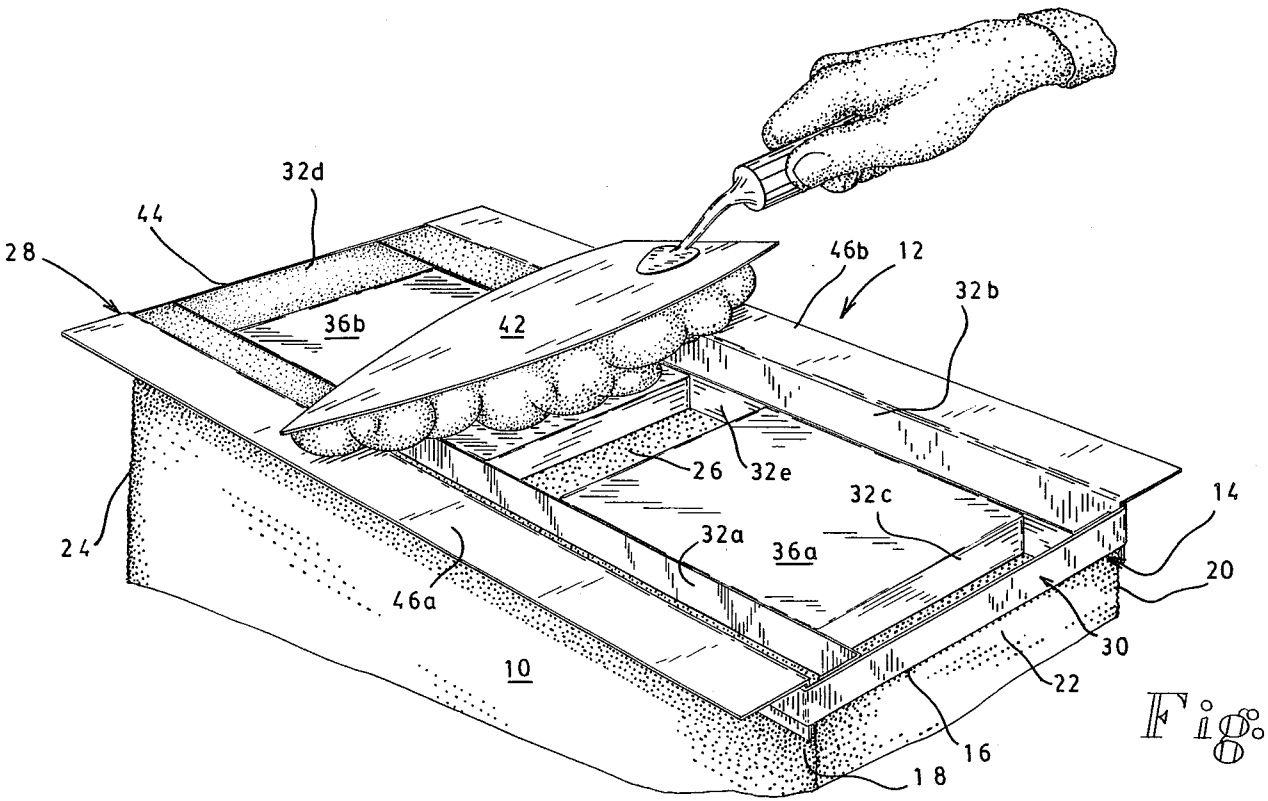
FIG. 2 illustrates a perspective view of the device as it is actually being used during the application of mortar to the building surface of a precast block.

Referring now to the Figures, a template device for applying mortar to a precast concrete block 10 is illustrated generally at 12 in FIGS. 1 and 2. This device 12 is designed to be positioned squarely on the upper building surface 14 of the block 10. It will be recognized by those skilled in the art that this block surface 14 includes a substantially rectangular perimeter having parallel longitudinal sections 18 and 20 which are joined at their opposite ends by parallel lateral sections 22 and 24, respectively, of lesser length. These lateral sections interconnect the longitudinal sections 18 and 20. The longitudinal sections 18 and 20 of a conventional precast concrete block 10 are joined by at least one further lateral section such as the lateral section 26 which in the depicted embodiment interconnects the longitudinal sections 18 and 20 proximate their mid-portion such that the upper block surface 14 defines two openings (not shown) as will be recognized by those skilled in the art. In certain precast concrete blocks, an additional lateral section will be provided such that three openings are defined in the building surface 14 of the block. It will of course be recognized by those skilled in the art that a modification in the device 12 will be required to accommodate precast concrete block with more than two openings, but it is envisioned that such modification will not depart from the spirit or scope of the invention described.

The device 12 includes a frame generally indicated at 28. This frame 28 defines an outline similar to the outline of the surface 14 of the block 10. The frame includes wall means generally indicated at 30 which define a purality of openings 32 *a–e*. It will be noted that upon positioning the device 12 squarely on a concrete block such that the lower surface 34 (see FIG. 1) defined by the wall means 30 rests on the upper building surface 14 of the block 10, these openings 32 *a–e* are subtantially coextensive with and in registery with the juxtaposed longitudinal and lateral sections of the block surface 14.

The depth of the wall means 30 is preselected such that it is substantially equal to the desired thickness of the mortar to be applied to the block surface. Thus, when it is desired to have the mortar thickness of approximately one half inch, which is customary, the wall means 30 will have a depth of approximately one half inch. While the wall means 30 in the depicted embodiment comprises a purality of thin stripes of semi-ridgid material joined together to form the frame and define the openings described above, it will be recognized that various types of wall means can be used as necessary or desired. Further, it will be noted that the wall means 30 defines members 36*a* and 36*b* which serve to cover the openings in the block 10 such that mortar does not enter these openings.

In order to facilitate placement of the device 12 on the upper surface 14 of the block 10 in proper alignment, guide means generally indicated at 40*a–b* in FIG. 1 are provided. The illustrated guide means is carried by the frame proximate with lower surface 34 thereof. These guide means extend downwardly from the lower surface 34 and comprise a parallel pair of elongated members which engage the block proximate the longitudinal sections 18 and 20 thereof such that the device can be positioned whereby its openings are squarely aligned with the juxtaposed longitudinal and lateral sections of the block surface 14. These members 40*a* and 40*b* in the illustrated embodiment, extend substantially along the length of the frame 28 and facilitate slidding the device 12 along the course as blocks are added thereto.

Upon positioning the device 12 such that its openings align with the juxtaposed sections of the block surface 14 with the assistance of the guide means, mortar is applied to the device by the user as with the trowel depicted in FIG. 2 at 42. The trowel applies the mortar along the top surface 44 of the device. This mortar fills the openings 32*a–e* in the device and in doing so is applied to the longitudinal and lateral sections of the block in a preselected thickness equal to the thickness of the frame wall.

The mortar remains on the block surface when the device 12 is removed. This upper surface 44 of the device 12 include flared longitudinal members 46*a* and 46*b*. These members 46*a–b* are in the plane of the upper surface 44 of the device. It will be noted that they assist in catching excess mortar such that it does not fall over the edges of the block which would cause waste. It will be noted in FIG. 2, that the flared longitudinal members 46*a–b* are integrally formed with the guides 40*a* and 40*b*. More specifically, the flared members and the guide are formed by a angled member depicted in FIG. 1 which is connected with the frame member defining the outer most portion of the wall mean serving to define the openings 32*a–b*. Of course, alternate constructions can be used as necessary and desired to form the guides and the flared members.

It will also be noted that these flared longitudinal members 46*a–b* further serve as handles such that a user can grip the device at its opposite sides and readily move the device to a new location and place it in proper registry with the upper surface of the block.

From the foregoing detailed description, it will be recognized that an improved template device for applying mortar to a building surface of a precast concrete block or the like has been illustrated and described. This device defines a purality of openings therein which register with the longitudinal and lateral sections of the upper surface of the block. These openings may take various configurations as is necessary or desired such that the mortar is properly placed when applied to the device squarely positioned on the upper surface of a block. The device enables a novice to apply mortar to the upper building surface of a block with consistent placement and thickness such that a true wall course can be constructed without the need of advanced skills. The device can be inexpensively manufactured and is durable.

Thus, although there has been described to this point particular embodiments with the present invention directed to a template device for applying mortar to the building surface of a precast concrete block, it is not intended that such specific references be considered as limitations upon the scope of this invention except insofar as the following claims and equivalents thereof.

I claim:

1. A template device for applying mortar to the exposed top surface of a precast concrete block or the like upon which other blocks are to be stacked during building operations, said top surface including a substantially rectangular perimeter having parallel longitudinal sections joined at their ends by parallel lateral sections of lesser length and at least one further parallel lateral interconnecting the longitudinal sections at a spaced location from their ends such that said top surface defined at least two openings spaced apart by said further parallel lateral sections, said template device comprising:

a frame having an outline similar to said rectangular perimeter of said top surface and including wall means defining mortar receiving openings which are substantially coextensive with said longitudinal and lateral sections of said top surface upon proper placement of said frame on said top surface, said wall means having a depth substantially equal to a desired thickness of mortar to be applied to said top surface, said frame member further including cover members attached to said wall means substantially coextensive with said openings in said top surface when said frame is properly placed on said top surface; and guide means carried by said frame for proper placement of said frame on said top surface whereby said mortar receiving openings therein properly register with said sections of said top surface and said cover members register with said openings in said top surface when a user places said device on said surface of said block and applies mortar thereto as with a trowel, said mortar filling said mortar receiving openings in said device and thereby being applied to said sections of said top surface in a thickness substantially said thickness of said frame wall means without mortar falling into said openings in said top surface.

2. The device of claim 1 wherein said wall means includes a plurality of elongated strips of semi-rigid material which assist in defining said mortar receiving openings therein, and said cover members are of semi-rigid material.

3. The device of claim 1 wherein said wall means defines a substantially planar lower surface which rests on said top surface when said device is placed thereon, and a substantially planar upper surface which serves as a guide for said trowel when excess mortar is being scraped away whereby said thickness of said mortar applied to said sections of said top surface can be substantially controlled by said device.

4. The device of claim 3 wherein said guide means extends downwardly from said lower surface of said wall means and comprises a parallel pair of elongated members which engage said block proximate said longitudinal sections of said block surface.

5. The device of claim 3 including handle means to facilitate gripping and moving said device by a user, said handle means formed by a horizontal extension from said upper surface of said wall means along said longitudinal sections of said top surface.

6. A template device for applying mortar to a top surface of a precast concrete block or the like, upon which other blocks are to be stacked during building operations, said top surface including a substantially rectangular perimeter and having parallel longitudinal sections joined at their ends by parallel lateral sections of lesser lengths, and a further parallel lateral section interconnecting said longitudinal sections at a spaced location from their ends such that said top surface of said block defines two openings spaced apart by said further parallel lateral section, said template device comprising:

a frame fabricated from a semi-rigid material having an outline substantially similar to the outline of said perimeter of said top surface of said block, said frame including wall means having a preselected depth of approximately one half inch, said wall means defining mortar receiving openings which are substantially coextensive with said longitudinal and lateral sections of said top surface upon proper placement of said frame on said top surface, said frame further including a pair of cover members attached to said wall means substantially coextensive with said two openings in said top surface upon proper placement of said frame on said top surface;

guide means comprised of a pair of substantially linear members extending downwardly from said device and being carried proximate said longitudinal sections of said top surface, said guide members extending downwardly approximately one quarter of an inch to facilitate proper placement of said device on a block to which mortar is to be applied; and handle means carried by said device to facilitate gripping and moving of said device by a user, said handle means comprising a pair of longitudinal members extending outwardly from said frame of said device and lying substantially in an upper plane thereof, said members also serving to catch excess mortar applied to said device.

7. The device of claim 6 wherein said wall means defines a substantially planar lower surface which rests on said surface of said block when said device is placed thereon, and a substantially planar upper surface which serves as a guide for said trowel when excess mortar is being scraped away whereby the thickness of said mortar applied to said sections of said block surface can be substantially controlled by said device.

* * * * *